US009944099B2

(12) United States Patent
Hori et al.

(10) Patent No.: US 9,944,099 B2
(45) Date of Patent: Apr. 17, 2018

(54) PRINTING APPARATUS AND PRINTING METHOD

(71) Applicant: SEIKO EPSON CORPORATION, Tokyo (JP)

(72) Inventors: Naoki Hori, Matsumoto (JP); Masashi Oba, Matsumoto (JP); Kunihiro Kawada, Matsumoto (JP); Shinji Kawakami, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/463,075

(22) Filed: Mar. 20, 2017

(65) Prior Publication Data

US 2017/0274683 A1 Sep. 28, 2017

(30) Foreign Application Priority Data

Mar. 25, 2016 (JP) ..... 2016-061282

(51) Int. Cl.
*B41J 29/38* (2006.01)
*B41J 15/04* (2006.01)
*B41J 11/46* (2006.01)

(52) U.S. Cl.
CPC ..... *B41J 15/04* (2013.01); *B41J 11/46* (2013.01)

(58) Field of Classification Search
USPC ..... 347/13, 14, 16, 19; 399/384
See application file for complete search history.

(56) References Cited

U.S. PATENT DOCUMENTS 7,021,738 B2 * 4/2006 Juan ..... B41J 3/543 341/11
7,515,284 B2 * 4/2009 Hanazato ..... B41J 11/46 358/1.1
7,658,460 B2 * 2/2010 Aoki ..... B41J 2/515 347/13
2002/0081132 A1 * 6/2002 Miyamoto ..... B41J 3/60 399/384
2012/0242735 A1 9/2012 Izawa et al.

FOREIGN PATENT DOCUMENTS

JP 2012-200976 A 10/2012
JP 2012200976 A 10/2012

OTHER PUBLICATIONS

European Search Report issued in Application No. 17162890 dated Oct. 4, 2017.

* cited by examiner

*Primary Examiner* — Lam Nguyen
(74) *Attorney, Agent, or Firm* — Workman Nydegger

(57) ABSTRACT

An output value of the transport position output portion when a first mark which is provided in a recording medium is at a predetermined position with respect to a detection region is stored in a storage portion as a reference value, and a start timing of the printing of the image is controlled based on the timing at which the mark detection portion detects the mark after confirming that the first mark reaches a predetermined range from the detection region based on comparison of the output value of the transport position output portion and the reference value with each other, when the transport in the first direction of the recording medium is started.

10 Claims, 12 Drawing Sheets

PRINTING APPARATUS AND PRINTING METHOD

BACKGROUND

1. Technical Field

The present invention relates to a technology of controlling a timing of starting printing of an image on a transported recording medium based on a timing at which a mark provided in the recording medium is detected.

2. Related Art

In JP-A-2012-200976, a digital printing apparatus is described which prints an image on a rotary paper sheet by an ink jet printer while transporting (sending normally) the rotary paper sheet in the normal direction. When restarting the printing after stopping the printing, the digital printing apparatus normally sends the rotary paper sheet after transporting (sending reversely) the rotary paper sheet in the reverse direction to the normal direction, and makes the ink jet printer start the printing. In particular, the restart of the printing is controlled based on the result of detecting a plurality of timing marks which are aligned in the normal direction and are attached to the rotary paper sheet. Specifically, the number of timing marks detected by a mark sensor while reversely sending the rotary paper sheet is counted. In addition, when the normal sending of the rotary paper sheet is started for restarting the printing, the number of timing marks detected by the mark sensor is counted, and at a timing at which a counted value matches the counted value during the reverse sending, the ink jet printer starts the printing.

However, it is not necessarily easy to reliably detect the mark by the sensor through the entire period during which the reverse transport (reverse sending) and the normal transport (normal sending) are performed. This is because there is a case where some marks pass through a position separated from a detection region of the sensor, for example, since meandering of a recording medium (rotary paper sheet) is generated. Meanwhile, in the above-described method of counting the marks detected by the sensor during each of the reverse transport and the normal transport, when the sensor fails in detecting the mark during any of the reverse transport and the normal transport, it is not possible to start the printing from an appropriate position of the recording medium.

SUMMARY

An advantage of some aspects of the invention is to provide a technology which can start printing of an image from an appropriate position of a recording medium in a technology of printing the image on the transported recording medium.

The invention can be realized in the following aspects.

According to an aspect of the invention, there is provided a printing apparatus including: a transport portion which transports a recording medium in a first direction; a transport position output portion which outputs a transport position of the recording medium by the transport portion; a printing portion which prints an image on the recording medium; a mark detection portion which detects a mark in a detection region among a plurality of marks which are aligned in the first direction and are provided in the recording medium; a storage portion which performs storage using an output value of the transport position output portion when a first mark that corresponds to a position at which printing of the image is started is at a predetermined position with respect to the detection region among the plurality of marks, as a reference value; and a control portion which performs printing processing of printing the image on the recording medium by allowing the printing portion to start the printing of the image after allowing the transport portion to transport the recording medium in the first direction from a state where the first mark is positioned further on an upstream side in the first direction than the detection region, in which the control portion controls a start timing of the printing of the image by the printing portion based on a timing at which the mark detection portion detects the mark after confirming that the first mark reaches a predetermined range from the detection region based on comparison of an output value of the transport position output portion and the reference value with each other, in the printing processing.

According to another aspect of the invention, there is provided a printing method including: starting transport of a recording medium in a first direction from a state where a first mark which corresponds to a position at which printing of an image is started is positioned further on an upstream side in the first direction than a detection region of a mark detection portion among a plurality of marks which are aligned in the first direction and are provided in the recording medium; and starting printing of an image on the recording medium transported in the first direction based on an output value of a transport position output portion which outputs a transport position of the recording medium, and a timing of detecting the mark in which the mark detection portion passes through the detection region, in which the output value of the transport position output portion when the first mark is at a predetermined position with respect to the detection region is stored in a storage portion as a reference value, and in which a start timing of the printing of the image is controlled based on the timing at which the mark detection portion detects the mark after confirming that the first mark reaches a predetermined range from the detection region based on comparison of the output value of the transport position output portion and the reference value with each other, when the transport in the first direction of the recording medium is started.

In the aspects configured in this manner, the output value of the transport position output portion when the first mark is at the predetermined position with respect to the detection region of the mark detection portion is stored in the storage portion as the reference value in advance. In addition, when the transport in the first direction of the recording medium is started, it is confirmed that the first mark reaches the predetermined range from the detection region based on comparison of the output value of the transport position output portion which outputs the transport position of the recording medium and the reference value with each other, and after this, the start timing of the printing of the image is controlled based on the timing at which the mark detection portion detects the mark. Therefore, the mark detection portion may detect at least the mark which passes through the detection region after the first mark reaches the predetermined range from the detection region, and it is not necessary to detect the mark through the entire period during which the reverse transport and the normal transport are performed. As a result, it is possible to suppress a possibility that the printing start position of the image is shifted due to a failure of the mark detection to be low, and that is, it is possible to start the printing of the image from an appropriate position of the recording medium.

In the printing apparatus, the storage portion may store the output value of the transport position output portion when the detection region is positioned between a second mark adjacent to the first mark and the first mark at a predetermined interval on the downstream side in the first direction, as the reference value. In the configuration, it is possible to use the output value of the transport position output portion when the first mark approaches the detection region as a reference value.

In the printing apparatus, the control portion may control the start timing of the printing of the image by the printing portion based on a timing at which the mark detection portion detects the mark first after the output value of the transport position output portion matches the reference value. In the configuration, the mark detection portion may at least detect the mark which passes through the detection region after the first mark reaches the range which is less than and close to a mark interval from the detection region. As a result, it is possible to suppress a possibility that the printing start position of the image is shifted due to a failure of the mark detection to be extremely low, and that is, it is possible to more reliably start the printing of the image from an appropriate position of the recording medium.

In the printing apparatus, the control portion may perform reference setting processing of matching the output value of the transport position output portion when the mark used as the first mark is at the predetermined position with respect to the detection region in the printing processing planned to be performed next, and the reference value stored in the storage portion, before performing the printing processing planned to be performed next. In the configuration, in the next printing processing, it is possible to start the printing of the image from the appropriate position of the recording medium.

In the printing apparatus, the transport portion may be capable of transporting the recording medium selectively in a second direction which is a reverse direction to the first direction and in the first direction, and, in the reference setting processing, the control portion may perform a position adjustment operation of positioning the first mark which corresponds to a printing start position of the image at the predetermined position in the printing processing planned to be performed next, by transporting the recording medium by the transport portion based on the output value of the transport position output portion when the printing of the image is finished in the printing processing performed in advance, and a setting operation of matching the output value of the transport position output portion when the position adjustment operation is completed and the reference value stored in the storage portion. In the configuration, in the next printing processing, it is possible to start printing of the image from an appropriate position of the recording medium.

In the printing apparatus, the printing portion may print the image and the mark on the recording medium in the printing processing, the transport portion may be capable of transporting the recording medium selectively in the second direction which is a reverse direction to the first direction and in the first direction, and, in the reference setting processing, the control portion may perform a confirming operation of confirming the output value of the transport position output portion when the first mark is positioned at the detection region, a position adjustment operation of positioning the first mark at the predetermined position by adjusting the transport position of the recording medium to the transport portion based on the output value of the transport position output portion confirmed in the confirming operation, and a setting operation of matching the output value of the transport position output portion when the position adjustment operation is completed and the reference value stored in the storage portion. In the configuration, in the next printing processing, it is possible to start the printing of the image from the appropriate position of the recording medium.

In the printing apparatus, the control portion may confirm the output value of the transport position output portion when the mark detection portion detects the mark first after starting the transport of the recording medium to the transport portion in the second direction from a state where the first mark is positioned further on an upstream side in the second direction than the detection region, in the confirming operation. Accordingly, it is possible to accurately confirm the output value of the transport position output portion when the first mark passes through the detection region in the confirming operation.

In the printing apparatus, the control portion may confirm the output value of the transport position output portion when the mark detection portion detects the mark first after starting the transport of the recording medium to the transport portion in the first direction from a state where the first mark is positioned further on the upstream side in the first direction than the detection region, in the confirming operation. Accordingly, it is accurately confirmed the output value of the transport position output portion when the first mark passes through the detection region in the confirming operation.

In the printing apparatus, an input operation portion may be provided, the transport portion may be capable of transporting the recording medium selectively in the second direction which is a reverse direction to the first direction and in the first direction in accordance with an input to the input operation portion, and, in the reference setting processing, the control portion may perform a position adjustment operation of positioning the first mark which corresponds to the printing start position of the image in the next printing processing at the predetermined position by transporting the recording medium by the transport portion based on an input to the input operation portion, and a setting operation of matching the output value of the transport position output portion when the position adjustment operation is completed and the reference value stored in the storage portion. In the configuration, in the next printing processing, it is possible to start the printing of the image from the appropriate position of the recording medium.

Incidentally, in the description above, meandering of the recording medium is described as an example of a reason of failure of mark detection. However, in the control of JP-A-2012-200976, it is also assumed that the mark detection is failed due to a reason different from the reason. Specifically, when the mark and the detection region overlap each other when the reverse transport is finished, there is a possibility of a failure in detecting the mark. Otherwise, there is also a possibility that a failure of detecting the image or the like different from the mark as a mark is generated.

In addition, all of the plural configuration elements having each of the above-described aspects of the invention are not necessary, and in order to solve a part or the entirety of the above-described problem, or in order to achieve a part or the entirety of effects described in the specification, a part of the plural configuration elements can be appropriately changed, removed, and replaced with other new configuration elements, and limited contents can be partially removed. In addition, in order to solve a part or the entirety of the above-described problem, or in order to achieve a part or the entirety of the effects described in the specification, a part or the entirety of technical characteristics included in one aspect of the above-described invention can be combined with a part or the entirety of the technical characteristics included in other above-described aspects of the invention, and also can be one independent aspect of the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
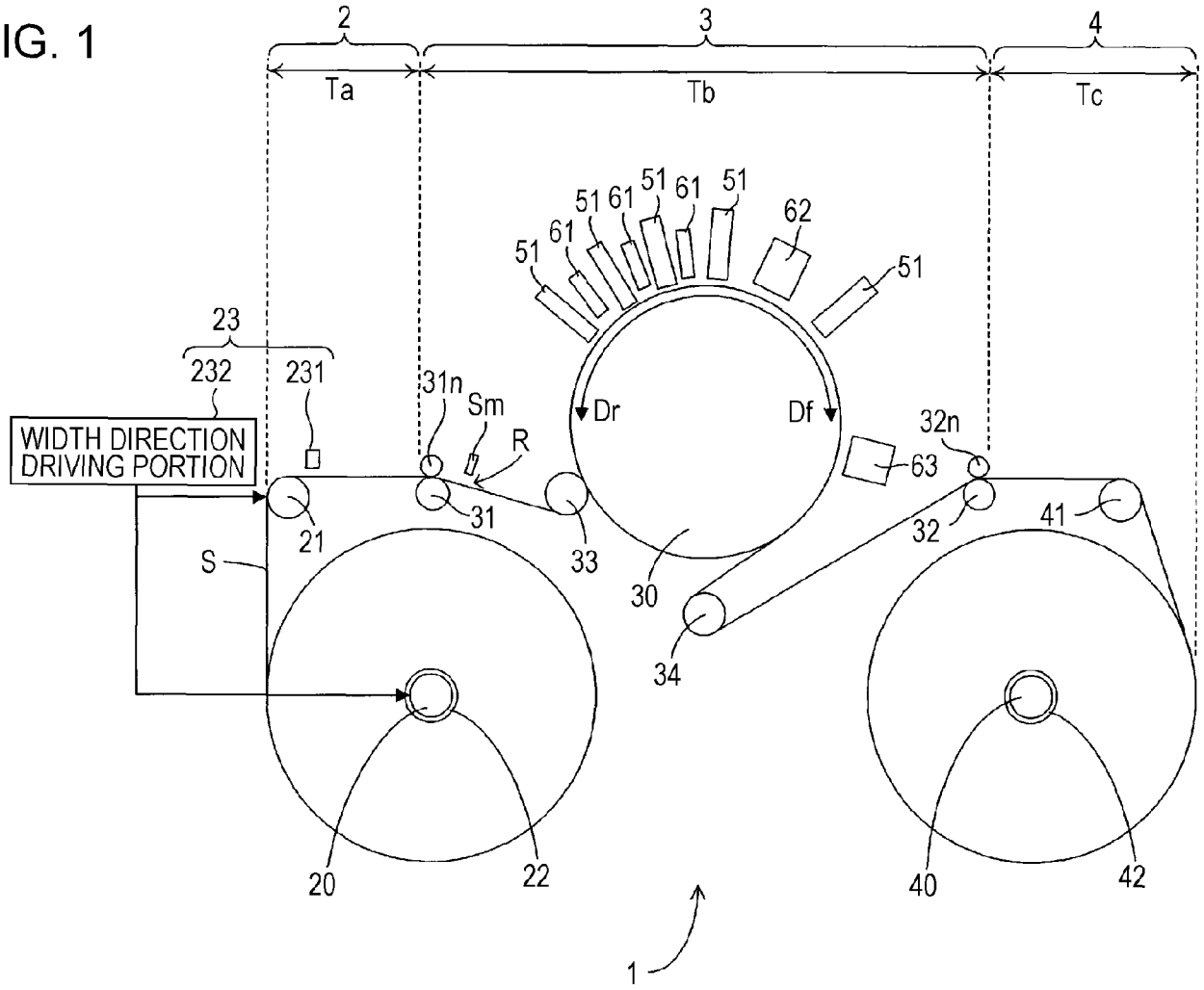
FIG. 1 is a front view schematically illustrating an example of an apparatus configuration of a printer which employs the invention.

FIG. 1 is a front view schematically illustrating an example of an apparatus configuration of a printer which employs the invention. As illustrated in FIG. 1, in a printer 1, one web S of which two ends are wound around a delivery shaft 20 and a winding shaft 40 in a rolled shape stretches along a transport path, and the web S receives printing while being transported in a normal direction Df toward the winding shaft 40 from the delivery shaft 20. The type of the web S is broadly classified into a paper type and a film type. Specific examples of the paper type include a pure paper sheet, a cast paper sheet, an art paper sheet, or a coated paper sheet, and specific examples of the film type include a synthetic paper sheet, a polyethylene terephthalate (PET) sheet or a polypropylene (PP) sheet. Schematically, the printer 1 includes a delivery portion 2 (delivery region) which delivers the web S from the delivery shaft 20, a process portion 3 (process region) which prints an image on the web S delivered from the delivery portion 2, and a winding portion 4 (winding region) which winds the web S on which the image is printed by the process portion 3 around the winding shaft 40. In addition, in the following description, regarding two surfaces of the web S, while a surface on which the image is printed is referred to as a front surface, and a surface on a side reverse thereto is referred to as a rear surface.

The delivery portion 2 includes the delivery shaft 20 around which the end of the web S is wound, and a driven roller 21 around which the web S delivered from the delivery shaft 20 is wound. The delivery shaft 20 winds and supports the end of the web S in a state where the front surface of the web S is toward the outside. In addition, as the delivery shaft 20 rotates clockwise of FIG. 1, the web S wound around the delivery shaft 20 is delivered to the process portion 3 via the driven roller 21. Incidentally, the web S is wound around the delivery shaft 20 via core tube 22 which is attachable to and detachable from the delivery shaft 20. Therefore, when the web S of the delivery shaft 20 is used up, the new core tube 22 around which the rolled web S is wound is mounted on the delivery shaft 20, and the web S of the delivery shaft 20 can be exchanged.

The delivery shaft 20 and the driven roller 21 can move in a width direction Dw (direction perpendicular to a paper surface of FIG. 1) orthogonal to the normal direction Df, and the delivery portion 2 includes a steering mechanism 23 which suppresses the meandering of the web S by adjusting positions of the delivery shaft 20 and the driven roller 21 in the width direction (shaft direction). The steering mechanism 23 is configured of an edge sensor 231 and a width direction driving portion 232. The edge sensor 231 is provided to oppose the end in the width direction of the web S on a downstream side in the normal direction Df of the driven roller 21, and detects the position of the end of the web S in the width direction. In addition, the width direction driving portion 232 moves the delivery shaft 20 and the driven roller 21 in the width direction in accordance with the detection result of the edge sensor 231. In this manner, the meandering of the web S is suppressed.

The process portion 3 appropriately performs processing by each of functional portions 51, 61, 62, and 63 which are disposed along the outer circumferential surface of a rotation drum 30 while supporting the web S which is delivered from the delivery portion 2 by the rotation drum 30, and records the image in the web S. In the process portion 3, a forward driving roller 31 and a rearward driving roller 32 are provided on both sides of the rotation drum 30, and the web S transported in the normal direction Df from the forward driving roller 31 to the rearward driving roller 32 is supported by the rotation drum 30, and receives the printing.

The forward driving roller 31 has a plurality of fine projections formed by thermal spraying on an outer circumferential surface, and winds the web S delivered from the delivery portion 2 from a rear surfaced side. In addition, as the forward driving roller 31 rotates clockwise of FIG. 1, the web S delivered from the delivery portion 2 is transported to the downstream side in the normal direction Df. In addition, a nip roller 31*n* is provided with respect to the forward driving roller 31. The nip roller 31*n* abuts against the front surface of the web S in a state of being biased to the forward driving roller 31 side, and nips the web S between the nip roller 31*n* and the forward driving roller 31. According to this, a friction force between the forward driving roller 31 and the web S is ensured, and the transport of the web S can be reliably performed by the forward driving roller 31.

The rotation drum 30 is a cylindrical drum which is supported to be rotatable in both directions including the normal direction Df and the reverse direction Dr reverse thereto by a support mechanism that is not illustrated, and which has a diameter of, for example, 400 [mm], and winds the web S transported from the forward driving roller 31 to the rearward driving roller 32, from the rear surface side. The rotation drum 30 supports the web S from the rear surface side while being driven to be rotated by the web S receiving the friction force between the rotation drum 30 and the web S. Incidentally, in the process portion 3, driven rollers 33 and 34 which fold back the web S are provided on both sides of a winding portion around the rotation drum 30.

The driven roller 33 of the rollers winds the front surface of the web S between the forward driving roller 31 and the rotation drum 30, and folds back the web S. Meanwhile, the driven roller 34 winds the front surface of the web S between the rotation drum 30 and the rearward driving roller 32, and folds back the web S. In this manner, by folding back the web S on each of the upstream and downstream sides in the normal direction Df with respect to the rotation drum 30, it is possible to ensure the winding portion of the web S around the rotation drum 30 to be long.

The rearward driving roller 32 has a plurality of fine projections formed by thermal spraying on the outer circumferential surface, and winds the web S delivered from the rotation drum 30 via the driven roller 34, from the rear surface side. In addition, as the rearward driving roller 32 rotates clockwise of FIG. 1, the web S is transported to the winding portion 4. In addition, a nip roller 32*n* is provided with respect to the rearward driving roller 32. The nip roller 32*n* abuts against the front surface of the web S in a state of being biased to the rearward driving roller 32 side, and nips the web S between the nip roller 32*n* and the rearward driving roller 32. According to this, a friction force between the rearward driving roller 32 and the web S is ensured, and the transport of the web S can be reliably performed by the rearward driving roller 32.

In this manner, the web S transported from the forward driving roller 31 to the rearward driving roller 32 is supported by the outer circumferential surface of the rotation drum 30. In addition, in the process portion 3, in order to record one color image with respect to the front surface of the web S supported by the rotation drum 30, a plurality of recording heads 51 which correspond to colors different from each other are provided. Specifically, four recording heads 51 which correspond to yellow, cyan, magenta, and black are aligned in the normal direction Df in the order of colors. Each of the recording heads 51 opposes the front surface of the web S wound around the rotation drum 30 at a slight clearance, and discharges ink (color ink) of a corresponding color from a nozzle in an ink jet method. In addition, as each of the recording heads 51 discharges the ink to the web S transported in the normal direction Df, a color image is formed on the front surface of the web S.

In addition, as ink, ultraviolet (UV) ink (photo-curing ink) which is cured by being irradiated with an ultraviolet ray (light) is used. Here, in the process portion 3, in order to fix the ink to the cured web S, UV irradiators 61 and 62 (light irradiating portion) are provided. In addition, the ink curing is performed by dividing the process into two steps including temporary curing and main curing. Between each of the plural recording heads 51, the UV irradiator 61 for the temporary curing is disposed. In other words, as the ultraviolet ray having weak irradiation strength is irradiated by the UV irradiator 61, compared to a case where the ultraviolet ray is not irradiated, the ink is cured (temporarily cured) to the extent that the wet-spreading of the ink is sufficiently slow, and the ink is mainly cured. Meanwhile, on the downstream side in the normal direction Df with respect to the plurality of recording heads 51, the UV irradiator 62 for the main curing is provided. In other words, by irradiating the ultraviolet ray having stronger irradiation strength than that of the UV irradiator 61, the UV irradiator 62 cures (mainly cures) the ink to the extent that the wet-spreading of the ink is stopped.

In this manner, the UV irradiator 61 which is disposed between each of the plural recording heads 51 temporarily cures the color ink discharged to the web S from the recording head 51 that is on the upstream side in the normal direction Df. Therefore, the ink discharged to the web S by one recording head 51 is temporarily cured until reaching the recording head 51 adjacent to the one recording head 51 that is on the downstream side in the normal direction Df. Accordingly, generation of mixed colors which is mixing of ink having different colors is suppressed. In a state where the color mixed in this manner is suppressed, the plurality of recording heads 51 discharge different colors of ink, and forms a color image in the web S. Furthermore, further on the downstream side in the normal direction Df than the plurality of recording heads 51, the UV irradiator 62 for the main curing is provided. Therefore, the color image formed by the plurality of recording heads 51 is mainly cured by the UV irradiator 62, and is fixed to the web S.

Furthermore, on the downstream side in the normal direction Df with respect to the UV irradiator 62, the recording head 51 is also provided. The recording head 51 opposes the front surface of the web S wound around the rotation drum 30 at a slight clearance, and discharges transparent UV ink from the nozzle to the front surface of the web S in the ink jet method. In other words, the transparent ink is further discharged to the color image formed by the recording heads 51 for four colors. The transparent ink is discharged to the entire surface of the color image, and gives texture, such as glossy sense or matt sense, to the color image. In addition, on the downstream side in the normal direction Df with respect to the recording head 51 which discharges the transparent ink, the UV irradiator 63 is provided. As a strong ultraviolet ray is irradiated, the UV irradiator 63 mainly cures the transparent ink discharged by the recording head 51. According to this, it is possible to fix the transparent ink to the front surface of the web S.

Incidentally, in the process portion 3, an optical mark sensor Sm which opposes the front surface of the web S is provided between the forward driving roller 31 and the driven roller 33. A detection region R of the mark sensor Sm is set on the front surface of the web S, and among eye marks M provided at an equivalent interval in one row along the normal direction Df on the front surface of the web S, an eye mark M positioned in the detection region R is detected by the mark sensor Sm. In addition, as will be described later, based on the detection result of the eye mark M by the mark sensor Sm, a timing of starting the discharge of the ink from the recording head 51 is controlled.

In this manner, in the process portion 3, the discharge and the curing of the ink are appropriately performed with respect to the web S wound around the outer circumferential portion of the rotation drum 30, and the color image coated with the transparent ink is formed. In addition, the web S in which the color image is formed is transported to the winding portion 4 by the rearward driving roller 32.

In addition to the winding shaft 40 around which the end of the web S is wound, the winding portion 4 includes a driven roller 41 which winds the web S from the rear surface side between the winding shaft 40 and the rearward driving roller 32. In a state where the front surface of the web S is oriented to the outside, the winding shaft 40 winds and supports the end of the web S. In other words, when the winding shaft 40 rotates clockwise of FIG. 1, the web S transported from the rearward driving roller 32 is wound around the winding shaft 40 via the driven roller 41. Incidentally, the web S is wound around the winding shaft 40 via a core tube 42 which is attachable to and detachable from the winding shaft 40. Therefore, when the web S wound around the winding shaft 40 is not full, it is possible to detach the web S from each core tube 42.

Figure 2:
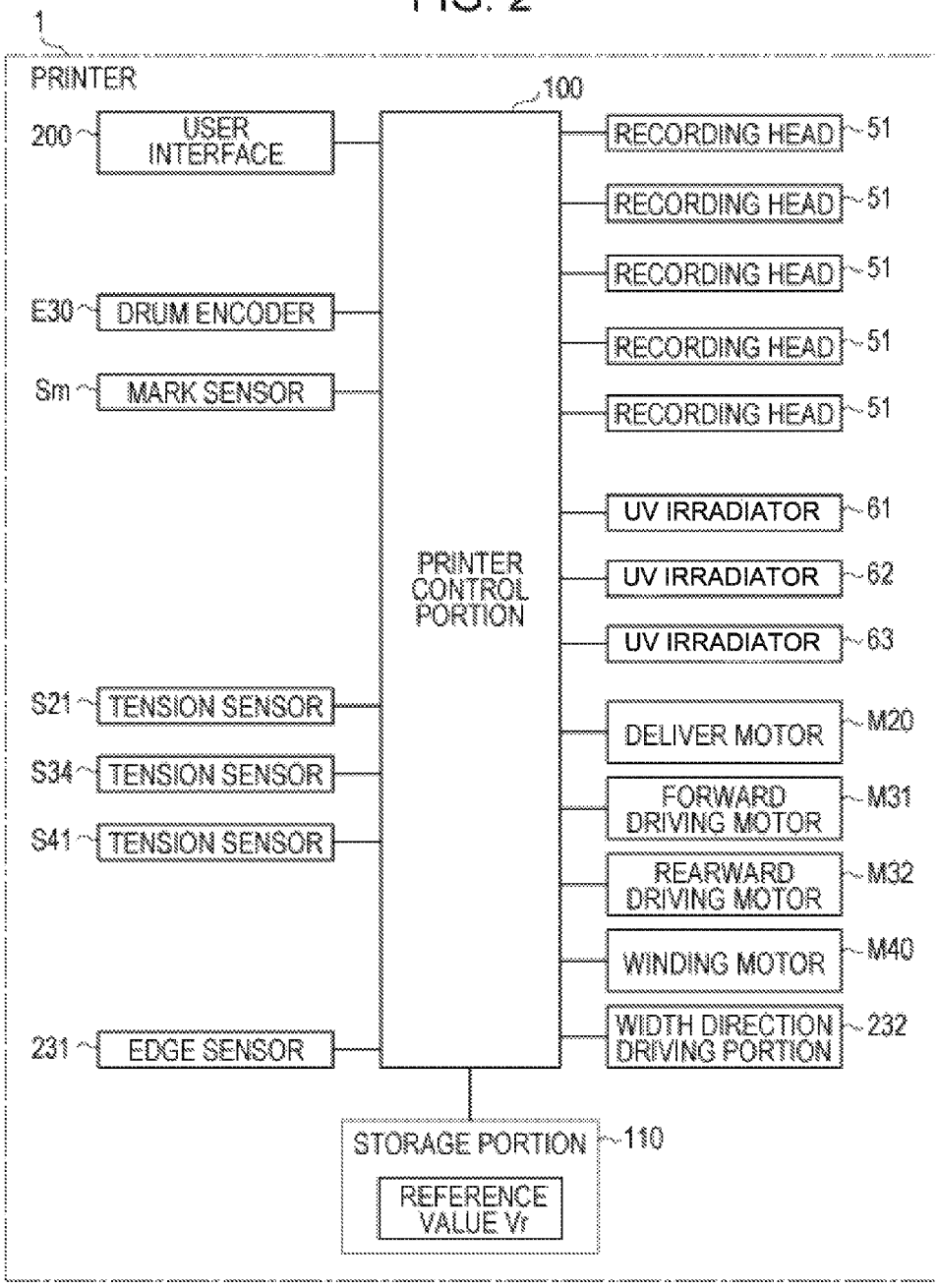
FIG. 2 is a block diagram illustrating an electric configuration of controlling the printer illustrated in FIG. 1.

The description above is an outline of the apparatus configuration of the printer 1. Next, an electric configuration which controls the printer 1 will be described. FIG. 2 is a block diagram illustrating the electric configuration of controlling the printer illustrated in FIG. 1. As illustrated in FIG. 2, in the printer 1, a printer control portion 100 which achieves a function of integrally controlling each portion of the apparatus, and a storage portion 110 which stores various programs or data used in the control by the printer control portion 100, are provided. The printer control portion 100 is a computer configured of a central processing unit (CPU) or a random access memory (RAM), and the storage portion 110 is a storage apparatus configured of a hard disk drive (HDD).

In addition, in the printer 1, a user interface 200 which functions as an interface between the printer control portion 100 and a user is provided. The user interface 200 is configured of input equipment, such as a mouse or a keyboard, and output equipment, such as a display. Therefore, the user can input a desirable command to the printer control portion 100 by operating the input equipment of the user interface 200, and can confirm an operation situation of the printer 1 by confirming the output equipment of the user interface 200. In addition, it is not necessary to configure the input equipment and the output equipment to be separated from each other, and the input equipment and the output equipment may be configured to be integrated with each other by a touch panel display or the like.

In addition, the printer control portion 100 controls the recording head, the UV irradiator, and each portion of a web transport type apparatus based on the command input by the user via the user interface 200 and the command received from other external equipment. The specific control is as follows.

The printer control portion 100 controls an ink discharge timing of each of the recording heads 51 which form the color image in accordance with the transport of the web S. Specifically, the control of the ink discharge timing is performed based on an output (detected value) of a drum encoder E30 which is attached to a rotation shaft of the rotation drum 30 and detects a rotation position of the rotation drum 30. In other words, in order to allow the rotation drum 30 to be driven to be rotated according to the transport of the web S, an output value of drum encoder E30 which detects the rotation position of the rotation drum 30, that is, the transport position of the web S, is illustrated. Here, as the printer control portion 100 generates a print timing signal (pts) signal from the output value of the drum encoder E30, and controls the ink discharge timing of each of the recording heads 51 based on the pts signal, the ink discharged by each of the recording heads 51 lands at a target position of the transported web S, and the color image is formed.

In addition, the timing at which the recording head 51 for the transparent ink discharges the ink is also similarly controlled by the printer control portion 100 based on the output value of the drum encoder E30. According to this, it is possible to accurately discharge the transparent ink to the color image formed by four colors of the recording heads 51. Furthermore, a timing of turning on and off or the irradiation amount of the UV irradiators 61, 62, and 63, is also controlled by the printer control portion 100.

In addition, the printer control portion 100 administers a function of controlling the transport of the web S described in detail by using FIG. 1. The transport control of the web S is mainly configured of a steering control and a tension control of the web S. The steering control is performed by using the steering mechanism 23 provided in the delivery portion 2. In other words, the printer control portion 100 feedback-controls the position of the web S in the width direction by adjusting the position in the width direction of the delivery shaft 20 and the driven roller 21 by the width direction driving portion 232 in accordance with a detection result of the edge sensor 231. In addition, the tension control is performed by using a motor connected to the delivery shaft 20, the forward driving roller 31, the rearward driving roller 32, and the winding shaft 40 among the members that configure the web transport type. The specific tension control of the web S is as follows.

The printer control portion 100 rotates a delivery motor M20 which drives the delivery shaft 20 by a direct driving method, and supplies the web S to the forward driving roller 31 from the delivery shaft 20. At this time, the printer control portion 100 controls torque of the delivery motor M20, and adjusts the tension (delivery tension Ta) of the web S to the forward driving roller 31 from the delivery shaft 20. In other words, a tension sensor S21 which detects the size of the delivery tension Ta is attached to the driven roller 21 disposed between the delivery shaft 20 and the forward driving roller 31. The tension sensor S21 can be configured of, for example, a load cell which detects the size of a force received from the web S. In addition, the printer control portion 100 feedback-controls the torque of the motor M20, and adjusts the delivery tension Ta of the web S based on the detection result (detected value) of the tension sensor S21.

In addition, the printer control portion 100 rotates a forward driving motor M31 which drives the forward driving roller 31, and a rearward driving motor M32 which drives the rearward driving roller 32. Accordingly, the web S delivered from the delivery portion 2 passes through the process portion 3. At this time, while a speed control is performed with respect to the forward driving motor M31, a torque control is performed with respect to the rearward driving motor M32. In other words, the printer control portion 100 feedback-controls the rotation speed of the forward driving motor M31 based on the output of the encoder of the forward driving motor M31. According to this, the web S is transported to the target position by the forward driving roller 31.

Meanwhile, the printer control portion 100 controls the torque of the rearward driving motor M32, and adjusts the tension (process tension Tb) of the web S from the forward driving roller 31 to the rearward driving roller 32. In other words, a tension sensor S34 which detects the size of the process tension Tb is attached to a driven roller 34 disposed between the rotation drum 30 and the rearward driving roller 32. The tension sensor S34 can be configured of, for example, a load cell which detects the size of a force received from the web S. In addition, the printer control portion 100 feedback-controls the torque of the rearward driving motor M32, and adjusts the process tension Tb of the web S based on the detection result (detected value) of the tension sensor S34.

In addition, the printer control portion 100 rotates a winding motor M40 which drives the winding shaft 40 by a direct driving method, and winds the web S transported by the rearward driving roller 32 around the winding shaft 40. At this time, the printer control portion 100 controls torque of the winding motor M40, and adjusts the tension (winding tension Tc) of the web S to the winding shaft 40 from the rearward driving roller 32. In other words, a tension sensor S41 which detects the size of the winding tension Tc is attached to the driven roller 41 disposed between the rearward driving roller 32 and the winding shaft 40. The tension sensor S41 can be configured of, for example, a load cell which detects the size of a force received from the web S. In addition, the printer control portion 100 feedback-controls the torque of the winding motor M40, and adjusts the winding tension Tc of the web S based on the detection result (detected value) of the tension sensor S41.

In addition, the printer control portion 100 performs printing processing of printing a two-dimensional image on the front surface of the web S by discharging the ink to the recording head 51 while transporting the web S in the normal direction Df by the motors M20, M31, M32, and M40. In particular, the printer control portion 100 controls a timing of starting the discharge of the ink from each of the recording heads 51 in the printing processing based on the detection result of the mark sensor Sm. Next, the control of the printer control portion 100 will be described in detail.

Figure 3:
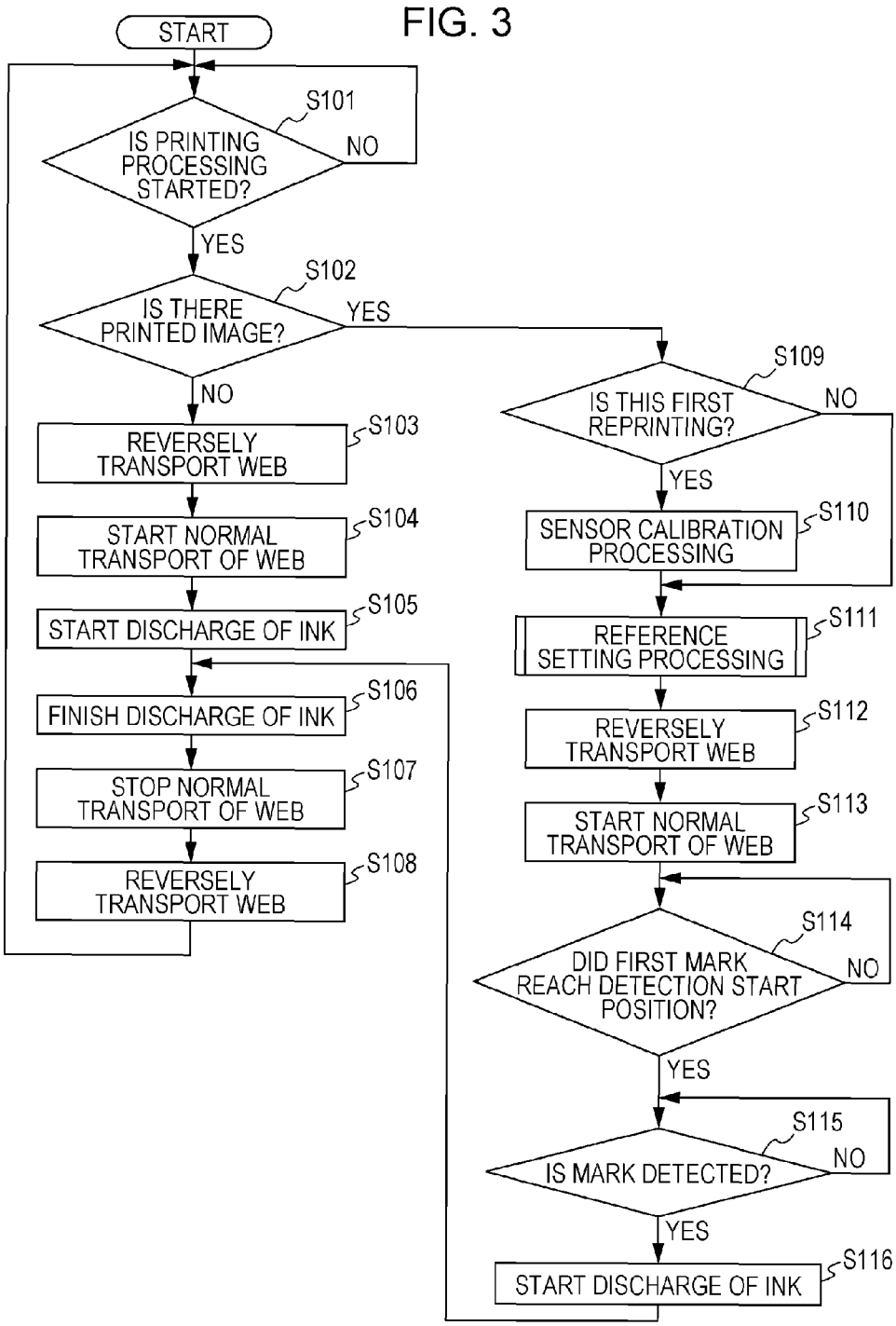
FIG. 3 is a flow chart illustrating a first control example performed by a printer control portion.
Figure 4:
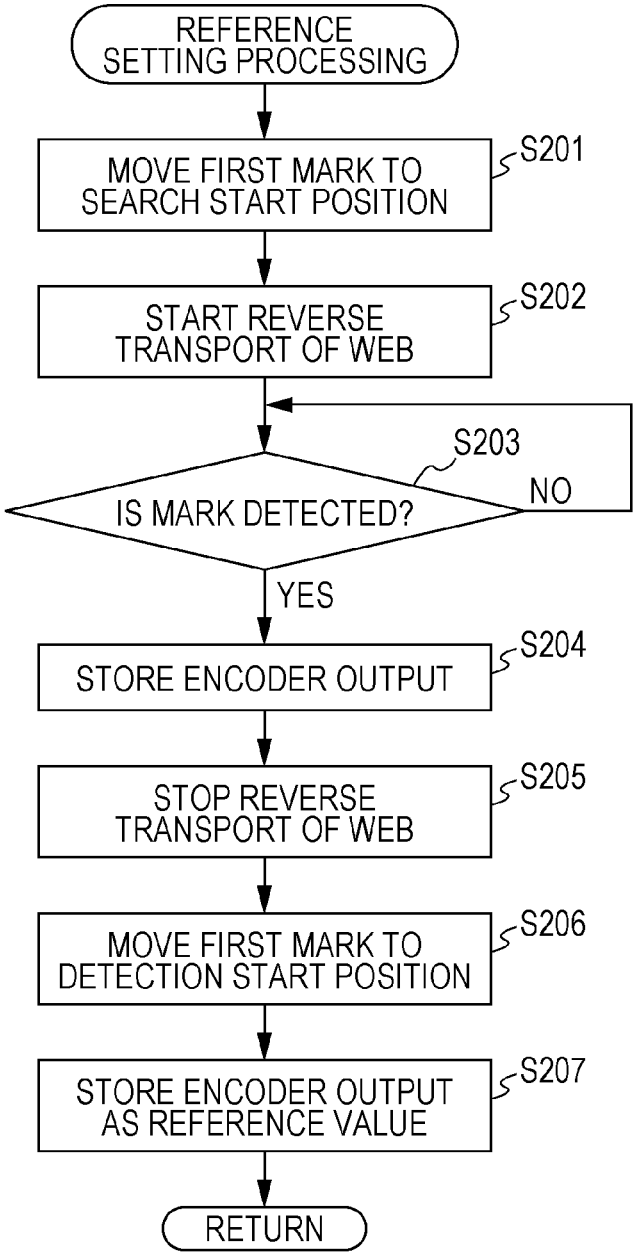
FIG. 4 is a flow chart illustrating an example of reference setting processing of the flow chart of FIG. 3.
Figure 5:
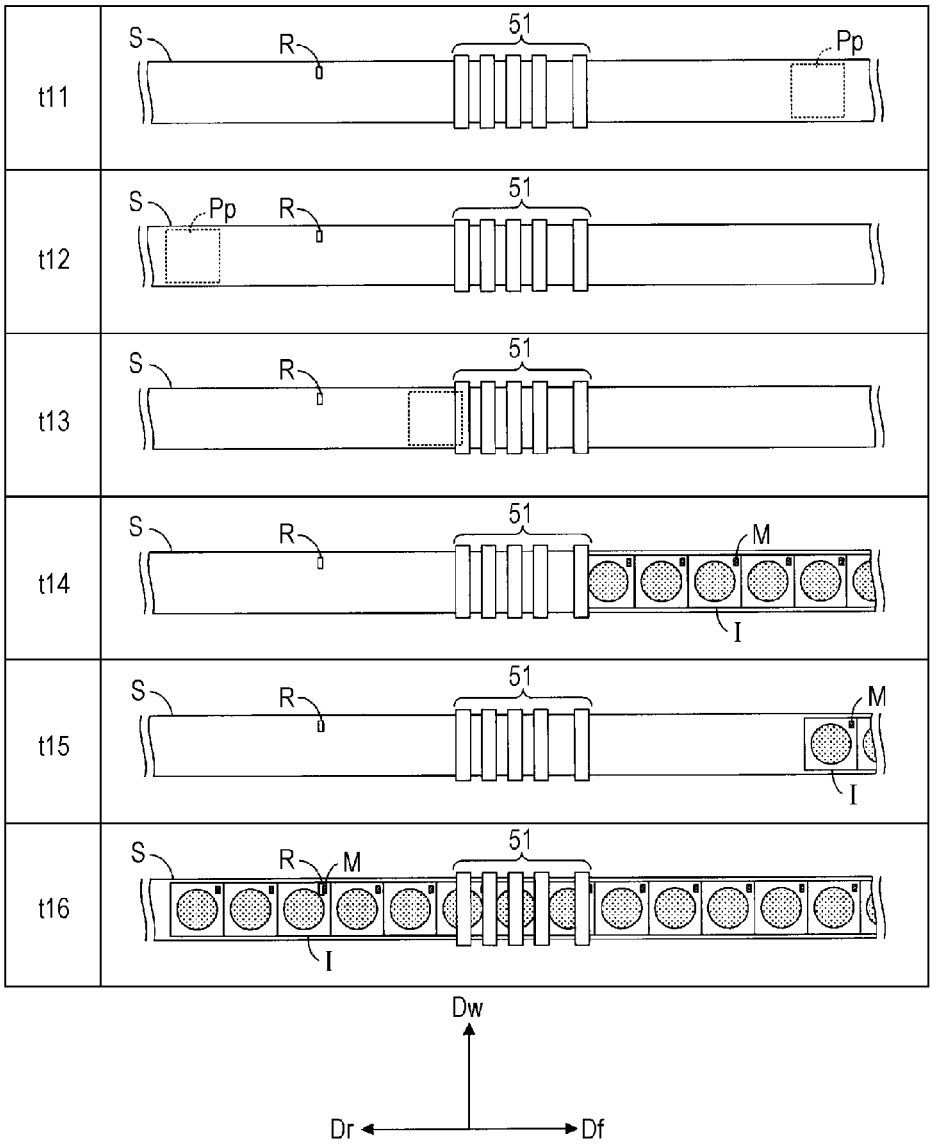
FIG. 5 is a view schematically illustrating an operation performed in the first control example in time series.

FIG. 3 is a flow chart illustrating a first control example performed by the printer control portion. FIG. 4 is a flow chart illustrating an example of reference setting processing performed in the flow chart of FIG. 3. FIGS. 5 to 8 are views schematically illustrating an operation performed in the first control example in time series. In addition, as illustrated in FIGS. 5 to 8, in the first control example, each of plural images I configured of rectangular ruled lines and circles surrounded by the ruled lines, and plural eye marks M is aligned in the normal direction Df and printed. In addition, in FIG. 5, a printing start position Pp illustrated by a solid line virtually illustrates a position at which the printing of the image I is started in the printing processing planned to be performed, and does not actually exist on the front surface of the web S.

When it is determined that the printing processing is started ("YES" in step S101), it is confirmed whether or not the image I which is printed on the web S exists (step S102). In the example, since the image I which is printed on the web S does not exist at a time t11, "NO" is determined in step S102, and the reverse transport of transporting the web S in the reverse direction Dr is performed (step S103). According to this, from the time t11 to a time t12, the printing start position Pp on the web S moves from the downstream side in the normal direction Df further to the upstream side in the normal direction Df than the detection region R of the mark sensor Sm by the recording head 51.

Next, when the normal transport of transporting the web S in the normal direction Df is started (step S104), and it is confirmed that the printing start position Pp reaches an ink discharge range of the recording head 51 based on the output value of the drum encoder E30 (time t13), the discharge of the ink from the recording head 51 is started. In this manner, the plurality of images I and the plurality of eye marks M are respectively printed on the web S being aligned in the normal direction Df. When the printing all of the images I which are planned to be printed is completed at the time t14, the discharge of the ink from the recording head 51 is finished (step S106), and the normal transport of the web S is stopped at a time t15 (step S107). In step S108, the reverse transport of the web S is performed. According to this, among the plurality of eye marks M aligned in a row in the normal direction Df, the eye mark M which is on the most upstream side in the normal direction Df moves further to the upstream side in the normal direction Df than the detection region R of the mark sensor Sm (time t16). In addition, returning to step S101, it is confirmed whether or not the printing processing is started.

Figure 6:
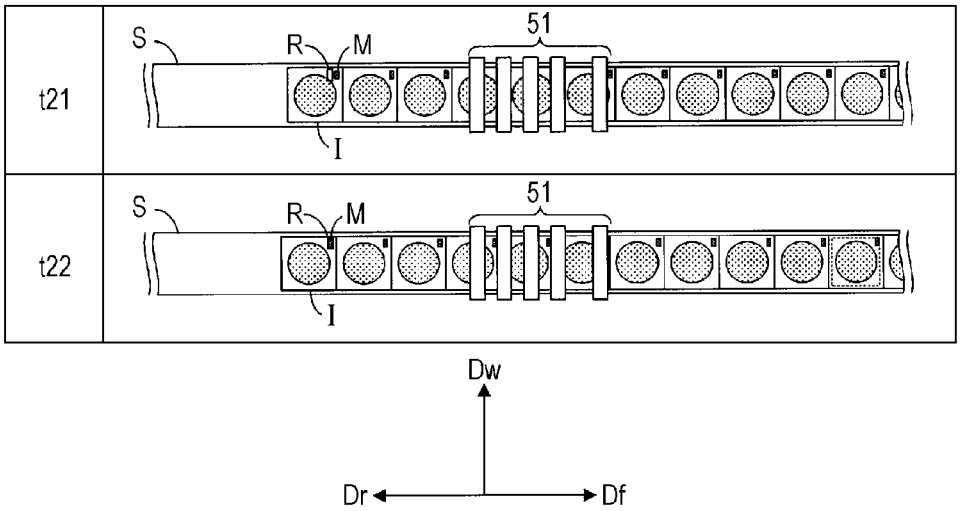
FIG. 6 is a view schematically illustrating the operation performed in the first control example in time series.

Furthermore, when it is determined that the printing processing is started ("YES" in step S101), it is determined whether or not the image I which is printed on the web S exists (step S102). In the example, since the image I printed by the printing processing in steps S104 to S107 exists in the web S, "YES" is determined in step S102, and the process moves to step S109. In step S109, it is confirmed whether or not the reprinting which performs the printing following the image I which is printed on the web S is to be performed for the first time. In the example, since the reprinting is a first reprinting, it is determined "YES" in step S109, and sensor calibration processing illustrated in FIG. 6 is performed (step S110).

In the sensor calibration processing, the web S is transported (time t21) so that the eye mark M which is on the most upstream side in the normal direction Df is positioned in the vicinity of the detection region R of the mark sensor Sm. In addition, an operation screen for allowing the user to perform the operation required for the sensor calibration processing is displayed in the user interface 200. Next, an operation of transporting the web S so that the eye mark M which is on the most upstream side in the normal direction Df is positioned in the detection region R of the mark sensor Sm is performed by the user via the operation screen (time t22). In addition, by operating the operation screen, the user performs calibration of the mark sensor Sm by matching the position to the eye mark M by finely adjusting the position of the detection region R of the mark sensor Sm in the width direction Dw, or by adjusting sensitivity (gain) of an amplifier embedded in the mark sensor Sm. In this manner, when the sensor calibration processing is finished, the process moves to step S111. In addition, in step S109, in a case where it is determined that the reprinting is not the first reprinting, that is, the reprinting is a reprinting after a second printing, step S110 is omitted, and the process moves to step S111.

Figure 7:
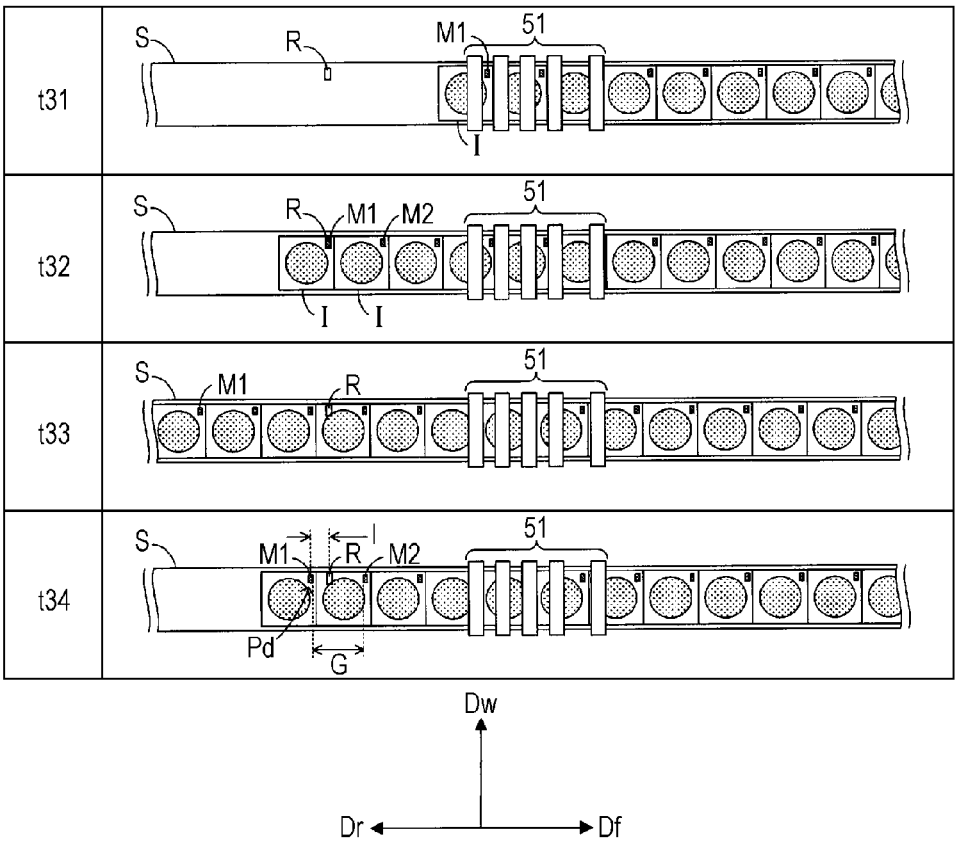
FIG. 7 is a view schematically illustrating the operation performed in the first control example in time series.

In step S111, reference setting processing illustrated in FIGS. 4 and 7 is performed. In step S201, the transport of the web S is performed so that a first mark M1 illustrating a position at which the printing of the image I is started in the printing processing planned to be performed next moves to a search start position among the plurality of eye marks M (time t31). In the example, the first mark M1 is the eye mark M which is on the most upstream side in the normal direction Df among the plurality of eye marks M, and the search start position is positioned at an appropriate position further on the downstream side in the normal direction Df than the detection region R of the mark sensor Sm. Next, the reverse transport of the web S is started (step S202), and it is confirmed whether or not the mark sensor Sm detects the eye mark M (step S203). In addition, when the first mark M1 reaches the detection region R of the mark sensor Sm at a time t32, the detection of the eye mark M by the mark sensor Sm is confirmed ("YES" in step S203), and at this time, the output value of the drum encoder E30 is stored in the storage portion 110 (step S204).

After the first mark M1 passes through the detection region R in the reverse direction Dr, the reverse transport of the web S is stopped in step S205 (time t33), and in step S206, the movement to a detection start position Pd of the first mark M1 is performed by the normal transport of the web S (time t34). Here, the detection start position Pd is a position provided in the vicinity of the detection region R in order to give the timing of starting the detection of the eye mark M in the printing processing planned to be performed next. Specifically, the detection start position Pd is set further on the upstream side in the normal direction Df than the detection region R only by a distance 1 which is shorter than a mark interval G between the adjacent eye marks M. Therefore, in a state at the time t34 at which the first mark M1 is positioned at the detection start position Pd, the detection region R of the mark sensor Sm is positioned between a second mark M2 adjacent to the first mark M1 and the first mark M1. The second mark M2 is positioned at the mark interval G on the downstream side in the normal direction Df relative to the first mark M1. Incidentally, the movement to the detection start position Pd of the first mark M1 can be performed by transporting the web S so that the output value of the drum encoder E30 proceeds in the reverse direction Df only by a distance which corresponds to the distance 1 from the output value stored in step S204. In addition, the output value of the drum encoder E30 when the first mark M1 is positioned at the detection start position Pd is stored in the storage portion 110 as a reference value Vr (FIG. 2) (step S207), and the process moves to step S112 of the flow chart of FIG. 3.

Figure 8:
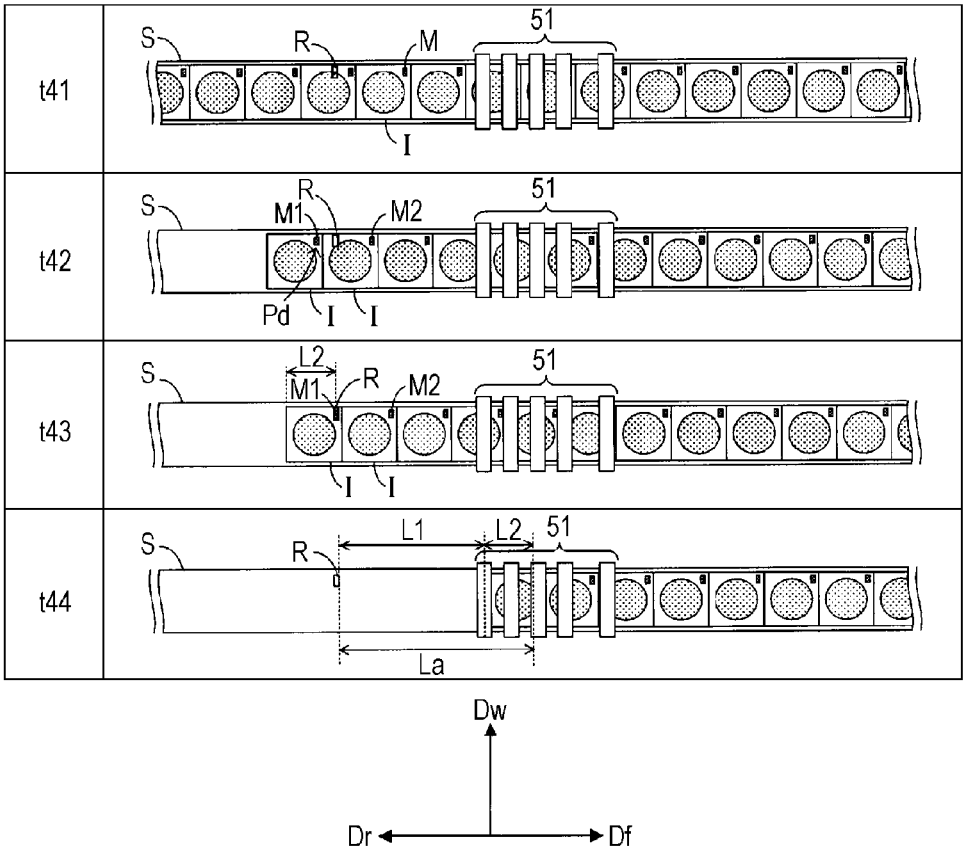
FIG. 8 is a view schematically illustrating the operation performed in the first control example in time series.

In step S112, as illustrated in FIG. 8, the reverse transport of the web S is performed (time t41). Next, the normal transport of the web S is started (step S113), and by confirming whether or not the output value of the drum encoder E30 matches the reference value Vr, it is determined whether or not the first mark M1 reaches the detection start position Pd (step S114). In addition, when the output value of the drum encoder E30 matches the reference value Vr at the time t42, and it is determined that the first mark M1 reaches the detection start position Pd ("YES" in step S114), the detection of the eye mark M is started by the mark sensor Sm (step S115).

When the first mark M1 reaches the detection region R at a time t43, and is detected by the mark sensor Sm ("YES" in step S115), at a time t44 at which the output value of the drum encoder E30 proceeds in the normal direction Df only by a distance which corresponds to a predetermined transport distance La from the output value at the time t43, the discharge of the ink from the recording head 51 is started (step S116). Here, the predetermined transport distance La corresponds to the transport distance of the web S until the printing start position of the image I, in which the first mark M1 is illustrated, reaches an ink discharge range of the recording head 51 after the first mark M1 passes through the detection region R. In the example, the transport distance La can be calculated by a sum of a distance L1 from the detection region R of the mark sensor Sm to the ink discharge range of the recording head 51, and a distance L2 from the first mark M1 to the printing start position of the image I in which the first mark M1 is illustrated. In this manner, at the time t44 at which the web S is normally transported only by the transport distance La from the time t43, an upstream end in the normal direction Df of the image I, that is, the printing start position in the printing processing planned to be performed, reaches the ink discharge range of the recording head 51. In addition, after the ink is discharged by the recording head 51, that is, after the printing of the image is started, similar to the description above, steps S106 to S108 are performed, and the process returns to step S101.

In the first control example described above, the output value of the drum encoder E30 when the first mark M1 is at the detection start position Pd set with respect to the detection region R of the mark sensor Sm is stored in the storage portion 110 as the reference value Vr in advance. In addition, when the transport in the normal direction Df of the web S is started, it is confirmed that the first mark M1 reaches the range (predetermined range) of the distance 1 from the detection region R based on the comparison of the output value of the drum encoder E30 which outputs the transport position of the web S and the reference value Vr with each other, and after this, based on the timing at which the mark sensor Sm detects the eye mark M, the start timing of printing of the image is controlled. Therefore, the mark sensor Sm may be employed as long as it is possible at least to detect the eye mark M which passes through the detection region R after the first mark M1 reaches the range of the distance 1 from the detection region R, and it is not necessary to detect the mark through the entire period during the reverse transport and the normal transport. As a result, it is possible to suppress a possibility that the printing start position of the image is shifted due to a failure of the mark detection to be low, that is, to start the printing of the image from the appropriate position of the web S.

In addition, in the storage portion 110, the output value of the drum encoder E30 when the detection region R is positioned between the first mark M1 and the second mark M2 adjacent thereto is stored as the reference value Vr. In the configuration, it is possible to use the output value of the drum encoder E30 when the first mark M1 approaches the detection region R as the reference value Vr.

However, the printer control portion 100 controls the start timing of the printing of the image by the recording head 51 based on the timing at which the mark sensor Sm detects the eye mark M first after the output value of the drum encoder E30 matches the reference value Vr. In the configuration, the mark sensor Sm may detect at least the eye mark M which passes through the detection region R after the first mark M1 reaches the range which is less than and close to the mark interval G from the detection region R. As a result, it is possible to suppress a possibility that the printing start position of the image is shifted due to a failure of the mark detection to be low, and that is, it is possible to more reliably start the printing of the image from an appropriate position of the web S.

In addition, the printer control portion 100 performs the reference setting processing of matching the output value of the drum encoder E30 when the eye mark M to be used as the first mark M1 in the printing processing planned to be performed next is at the detection start position Pd, and the reference value Vr stored in the storage portion 110, to each other in advance. In the configuration, in the next printing processing, it is possible to start the printing of the image I from the appropriate position of the web S.

In particular, in the reference setting processing, in steps S202 to S204, by confirming the detection result of the mark sensor Sm while transporting the web S, the output value of the drum encoder E30 when the first mark M1 passes through the detection region R is confirmed (confirming operation). Next, in step S206, the first mark M1 is positioned at the detection start position Pd by adjusting the transport position of the web S based on the output value of the drum encoder E30 confirmed by the confirming operation (position adjustment operation). In addition, in step S207, the output value of the drum encoder E30 when the position adjustment operation is finished is matched with the reference value Vr stored in the storage portion 110 (setting operation). Based on the reference value Vr set in this manner, it is possible to more reliably start the printing of the image from the appropriate position of the web S in the next printing processing.

At this time, the transport in the reverse direction Dr of the web S is started from a state where the first mark M1 is positioned further on the upstream side in the reverse direction Dr than the detection region R. In addition, by confirming the output value of the drum encoder E30 when the mark sensor Sm detects the eye mark M first, the confirming operations of step S202 to S204 are performed. According to this, in the confirming operation, it is possible to accurately confirm the output value of the drum encoder E30 when the first mark M1 passes through the detection region R.

In addition, the confirming operation may be performed as described in the following modification example. In the modification example, in the confirming operation, the transport in the normal direction Df of the web S is started from a state where the first mark M1 is positioned further on the upstream side in the normal direction Df than the detection region R. In addition, the output value of the drum encoder E30 when the mark sensor Sm detects the eye mark M last is confirmed. In the configuration, in the confirming operation, the output value of the drum encoder E30 when the first mark M1 passes through the detection region R can be accurately confirmed.

Figure 9:
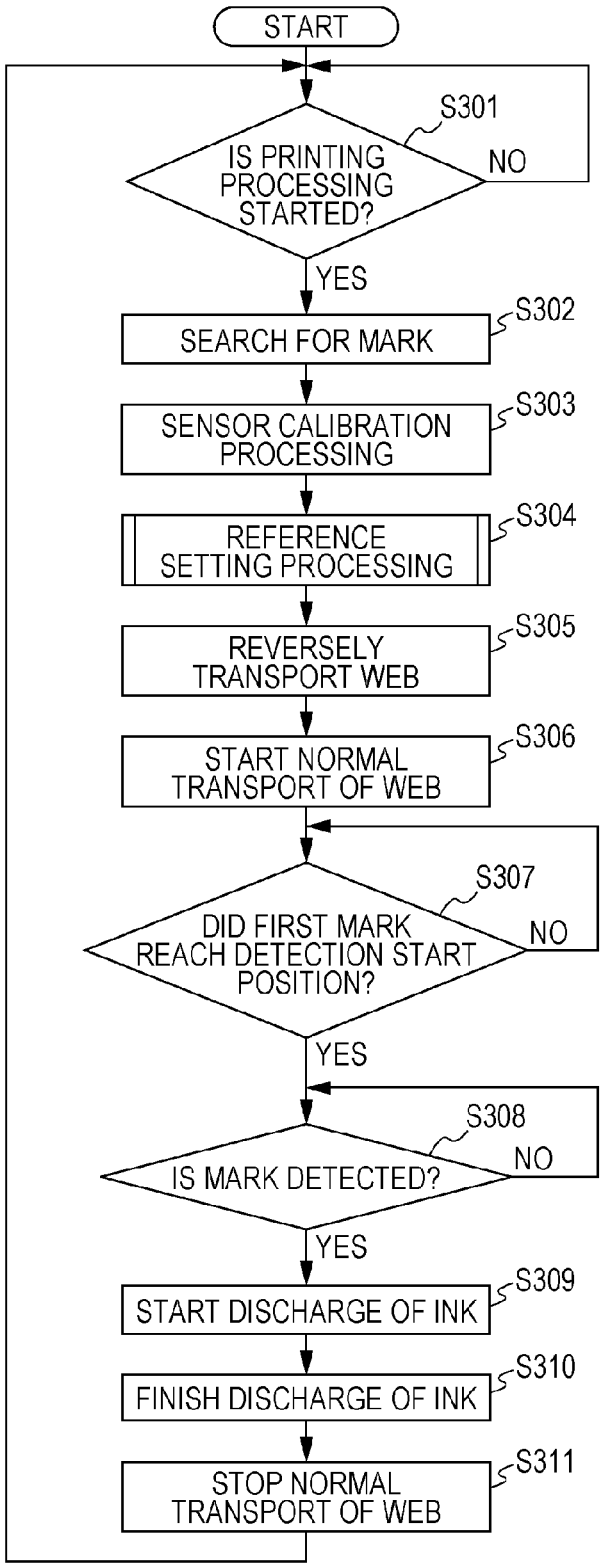
FIG. 9 is a flow chart illustrating a second control example performed by the printer control portion.
Figure 10:
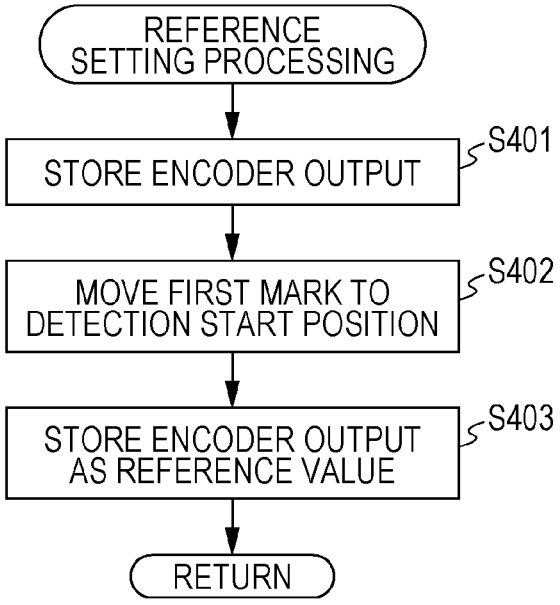
FIG. 10 is a flow chart illustrating an example of the reference setting processing of the flow chart of FIG. 9.
Figure 11:
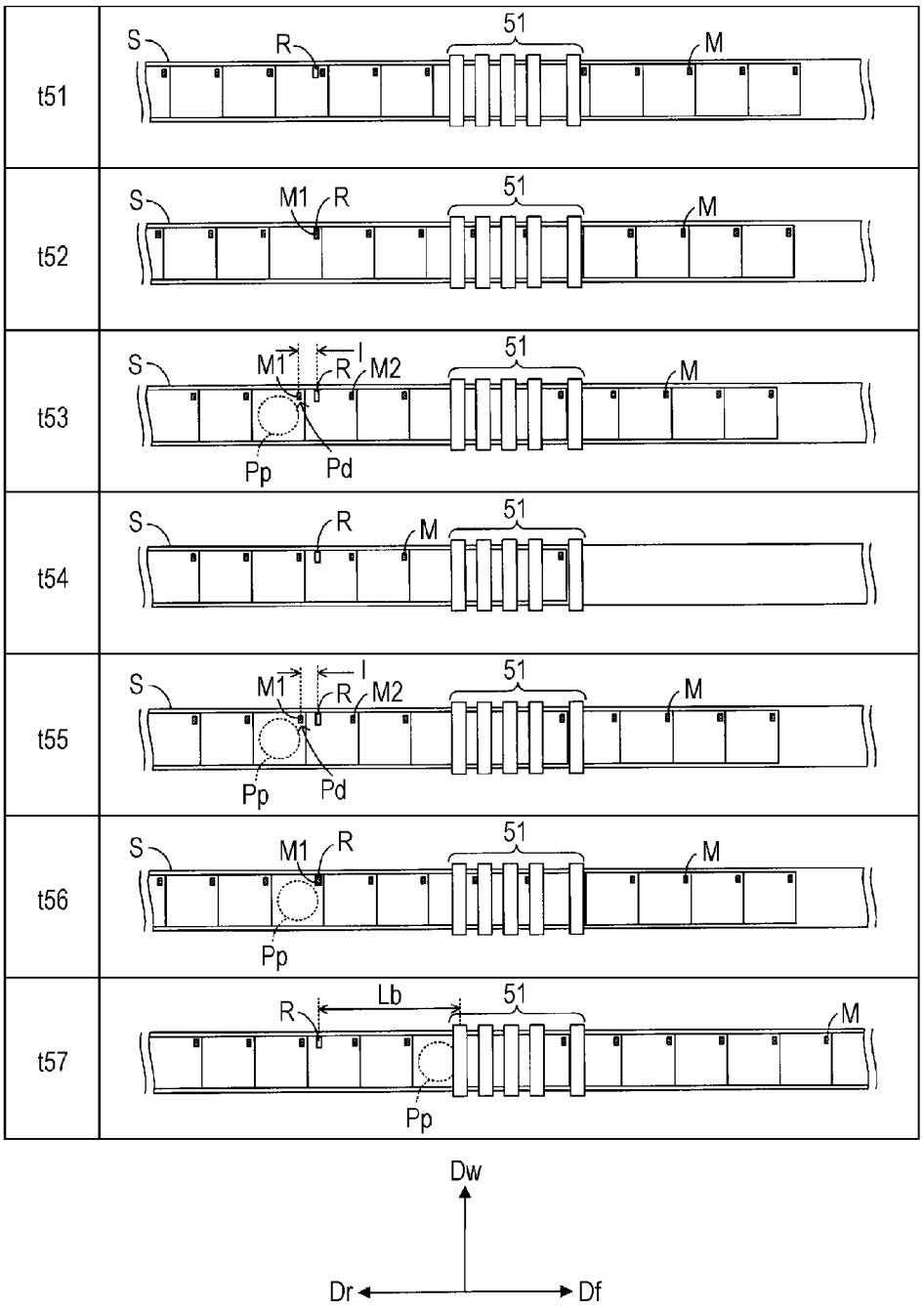
FIG. 11 is a view schematically illustrating an operation performed in a second control example in time series.

FIG. 9 is a flow chart illustrating a second control example performed by the printer control portion. FIG. 10 is a flow chart illustrating an example of the reference setting processing performed in the flow chart of FIG. 9. FIG. 11 is a view schematically illustrating an operation performed in the second control example in time series. In addition, a printing start position Pp illustrated by a broken line in FIG. 11 virtually illustrates a position at which the printing of the image I is started in the printing processing planned to be performed next, and does not actually exist on the front surface of the web S. As illustrated in FIG. 11, in the second control example, additional printing of printing the image I illustrated by a rectangular ruled line and a circle is performed with respect to the web S on which the eye marks M are printed in advance, is performed. Here, a difference between the modification example and the above-described embodiment will be focused in the description, and description of points which are common to those of the above-described embodiment will be appropriately omitted. However, it is needless to say that similar effects are achieved by providing common configurations.

When it is determined that the printing processing is started ("YES" in step S301), by confirming the detected value of the mark sensor Sm while performing the normal transport or the reverse transport of the web S, the eye mark M which is in the vicinity of the detection region R is searched (step S302). Specifically, the detected value of the mark sensor Sm is confirmed while transporting the web S by a fine amount, and the transport of the web S is stopped at the time when the mark sensor Sm detects the eye mark M. According to this, the eye mark M positioned in the vicinity of the detection region R at a time t51 is positioned in the detection region R at a time t52. In this state, similar to the above-described step S110, the sensor calibration processing is performed (step S303).

Next, in step S304, the reference setting processing illustrated in FIG. 10 is performed. The reference setting processing handles the eye mark M searched in step S302 as the first mark M1 illustrating the printing start position Pp, and the reference value Vr is set. Specifically, in step S401, the output value of the drum encoder E30 when the first mark M1 is positioned in the detection region R is stored in the storage portion 110. Next, in step S402, by reversely transporting the web S only by the distance 1, the movement to the detection start position Pd of the first mark M1 is performed (time t53). In addition, the output value of the drum encoder E30 when the first mark M1 is positioned at the detection start position Pd is stored in the storage portion 110 as the reference value Vr (FIG. 2) (step S403), and the process moves to step S305 of the flow chart of FIG. 9.

In step S305, as illustrated in FIG. 11, the reverse transport of the web S is performed (time t54). Next, the normal transport of the web S is started (step S306), and by confirming whether or not the output value of the drum encoder E30 matches the reference value Vr, it is determined whether or not the first mark M1 reaches the detection start position Pd (step S307). In addition, at a time t55, when the output value of the drum encoder E30 matches the reference value Vr, and it is determined that the first mark M1 reaches the detection start position Pd ("YES" in step S307), the detection of the eye mark M is started by the mark sensor Sm (step S308).

At a time t56, the first mark M1 reaches the detection region R, and is detected by the mark sensor Sm ("YES" in step S308). At a time t57, the output value of the drum encoder E30 proceeds in the normal direction Df only by a distance which corresponds to a predetermined transport distance Lb from the output value at the time t56, and then the discharge of the ink from the recording head 51 is started (step S309). According to this, at the timing when the printing start position Pp reaches the ink discharge range of the recording head 51, the discharge of the ink by the recording head 51, that is, the printing of the image is started. After this, as the printing of all of the images I is finished, the discharge of the ink is completed (step S310), and the normal transport of the web is stopped (step S311).

Incidentally, similar to the above-described transport distance La, the transport distance Lb corresponds to the transport distance of the web S until the printing start position Pp of the image I in which the first mark M1 is illustrated reaches the ink discharge range of the recording head 51 after the first mark M1 passes through the detection region R. Therefore, the transport distance Lb can be calculated by a sum of the distance L1 from the detection region R of the mark sensor Sm to the ink discharge range of the recording head 51, and the distance L2 from the first mark M1 to the printing start position Pp of the image I in which the first mark M1 is illustrated. However, in the example, since the position of the first mark M1 and the printing start position Pp (downstream end in the normal direction Df) match each other, the latter distance L2 becomes zero, and the transport distance Lb matches the distance L1. In addition, in a case where the first mark M1 in the normal direction Df exists further on the upstream side than the downstream end of the printing start position Pp, the transport distance Lb can be calculated by subtracting the distance L2 from the distance L1.

In the second control example described above, the output value of the drum encoder E30 when the first mark M1 exists at the detection start position Pd is also stored in the storage portion 110 as the reference value Vr in advance. In addition, it is confirmed that the first mark M1 reaches the range (predetermined range) of the distance 1 from the detection region R based on the comparison of the output value of the drum encoder E30 and the reference value Vr with each other, and after this, the start timing of the printing of the image is controlled based on the timing at which the mark sensor Sm detects the eye mark M. Therefore, it is possible to suppress a possibility that the printing start position of the image is shifted due to a failure of the mark detection to be low, and that is, it is possible to more reliably start the printing of the image from an appropriate position of the web S.

In addition, the printer control portion 100 performs the reference setting processing of matching the output value of the drum encoder E30 when the eye mark M to be used as the first mark M1 in the printing processing planned to be performed is at the detection start position Pd, and the reference value Vr stored in the storage portion 110, to each other in advance. Therefore, in the next printing processing, it is possible to start the printing of the image I from the appropriate position of the web S.

In particular, in the reference setting processing, in step S401, the output value of the drum encoder E30 when the first mark M1 is positioned in the detection region R is confirmed (confirming operation). Next, in step S402, the first mark M1 is positioned at the detection start position Pd by adjusting the transport position of the web S based on the output value of the drum encoder E30 confirmed in the confirming operation (position adjustment operation). In addition, in step S403, the output value of the drum encoder E30 when the position adjustment operation is finished is matched with the reference value Vr stored in the storage portion 110 (setting operation). Based on the reference value Vr set in this manner, it is possible to more reliably start the printing of the image from the appropriate position of the web S in the next printing processing.

Figure 12:
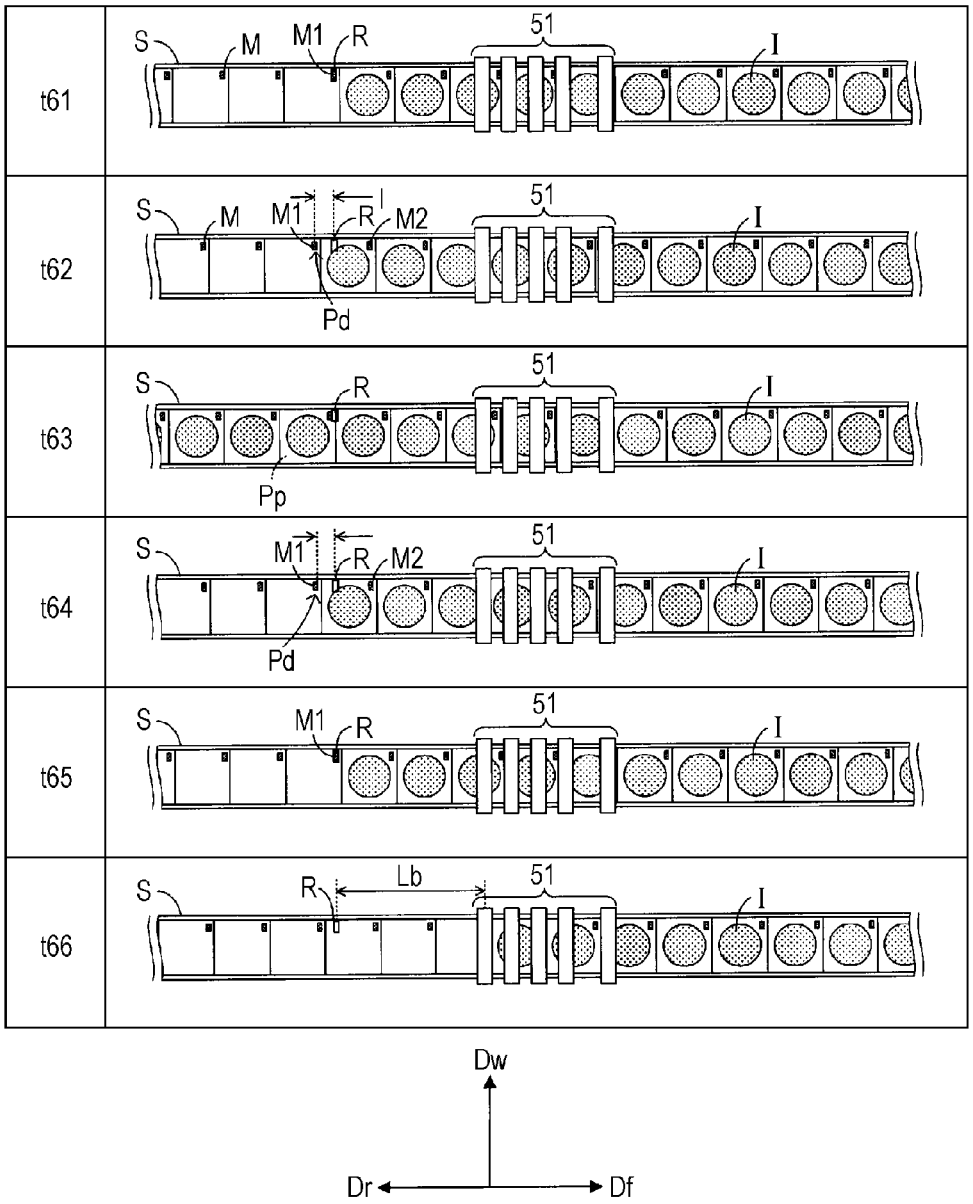
FIG. 12 is a view schematically illustrating an operation performed in a third control example in time series.

FIG. 12 is a view schematically illustrating an operation performed in a third control example in time series. As illustrated in FIG. 12, in the third control example, similar to the second control example, the additional printing of printing the image I illustrated by a rectangular ruled line and a circle is performed with respect to the web S on which the eye mark M are printed in advance. However, the third control example is different from the second control example in that a new image I is formed following the printed image I by further performing the printing processing from the state where the image I is printed in the printing processing performed in advance. Here, a difference between the embodiment and the above-described embodiment will be focused in the description, and description of points which are common to those of the above-described embodiment will be appropriately omitted. However, it is needless to say that similar effects are achieved by providing common configurations.

The third control example is performed according to the flow chart of FIG. 9 basically similar to the second control example. However, the reference setting processing is performed by using the input operation of the user. Specifically, the operation screen for allowing the user to perform the operation which is required for the reference setting processing is displayed in the user interface 200. Next, a dialog box which indicates that the first mark M1 is positioned in the detection region R by manual transport of the web S is displayed on the operation screen. In addition, as the user performs the operation according to the indication, the first mark M1 is positioned in the detection region R (time t61). In addition, in the example, first mark M1 is the one of the eye marks M associated with the image I which is printed on the most upstream side in the normal direction Df. Next, the dialog box which indicates that the web S is reversely transported only by the distance 1 is displayed on the operation screen, and when the user performs the operation according to the indication, the first mark M1 is positioned at the detection start position Pd (time t62). In addition, when the user performs the input operation illustrating that the reverse transport by the distance 1 is finished, the printer control portion 100 stores the output value of the drum encoder E30 as the reference value Vr in the storage portion 110.

When the reference setting processing is finished in this manner, the printer control portion 100 performs steps S305 to S311. In other words, in step S305, the reverse transport of the web S is performed (time t63). Next, the normal transport of the web S is started (step S306), and by confirming whether or not the output value of the drum encoder E30 matches the reference value Vr, it is determined whether or not the first mark M1 reaches the detection start position Pd (step S307). In addition, at a time t64, when the output value of the drum encoder E30 matches the reference value Vr, and it is determined that the first mark M1 reaches the detection start position Pd ("YES" in step S307), the detection of the eye mark M is started by the mark sensor Sm (step S308).

At a time t65, when the first mark M1 reaches the detection region R, and is detected by the mark sensor Sm ("YES" in step S308), at a time t66 at which the output value of the drum encoder E30 proceeds in the normal direction Df only by a distance which corresponds to a predetermined transport distance Lb from the output value at the time t65, the discharge of the ink from the recording head 51 is started (step S309). According to this, at the timing when the printing start position reaches the ink discharge range of the recording head 51, the discharge of the ink by the recording head 51, that is, the printing of the image is started. After this, as the printing of all of the images I is finished, the discharge of the ink is completed (step S310), and the normal transport of the web is stopped (step S311).

In the third control example described above, the output value of the drum encoder E30 when the first mark M1 is at the detection start position Pd is stored as the reference value Vr in the storage portion 110 in advance. In addition, it is confirmed that the first mark M1 reaches the range (predetermined range) of the distance 1 from the detection region R based on the comparison of the output value of the drum encoder E30 and the reference value Vr with each other, and after this, the start timing of the printing of the image is controlled based on the timing at which the mark sensor Sm detects the eye mark M. Therefore, it is possible to suppress a possibility that the printing start position of the image is shifted due to a failure of the mark detection to be low, and that is, it is possible to more reliably start the printing of the image from an appropriate position of the web S.

In addition, the printer control portion 100 performs the reference setting processing of matching the output value of the drum encoder E30 when the eye mark M to be used as the first mark M1 in the printing processing planned to be performed is at the detection start position Pd, and the reference value Vr stored in the storage portion 110, to each other in advance. Therefore, in the next printing processing, it is possible to start the printing of the image I from the appropriate position of the web S.

In particular, in the reference setting processing, by transporting the web S based on the input to the user interface 200, the position adjustment operation of positioning the first mark M1 which corresponds to the printing start position of the image in the next printing processing at the detection start position Pd is performed. In addition, the setting operation of matching the output value of the drum encoder E30 when the position adjustment operation is finished and the reference value Vr stored in the storage portion 110 to each other is performed. According to this, in the next printing processing, it is possible to more reliably start the printing of the image from the appropriate position of web S.

Above, in the above-described embodiments, the printer 1 corresponds to an example of a "printing apparatus" of the invention, the delivery shaft 20, the forward driving roller 31, the rearward driving roller 32, the winding shaft 40, and the motors M20, M31, M32, and M40 which drive the members, function as an example of a "transport portion" of the invention cooperating with each other, the drum encoder E30 corresponds to an example of a "transport position output portion" of the invention, the recording head 51 corresponds to an example of a "printing portion" of the invention, the mark sensor Sm corresponds to an example of a "mark detection portion" of the invention, the detection region R corresponds to an example of a "detection region" of the invention, the storage portion 110 corresponds to an example of a "storage portion" of the invention, the printer control portion 100 corresponds to an example of a "control portion" of the invention, the web S corresponds to an example of a "recording medium" of the invention, the normal direction Df corresponds to an example of a "first direction" of the invention, the reverse direction Dr corresponds to an example of a "second direction" of the invention, the eye mark M corresponds to an example of a "mark" of the invention, the first mark M1 corresponds to an example of a "first mark" of the invention, the second mark M2 corresponds to an example of a "second mark" of the invention, the detection start position Pd corresponds to an example of a "predetermined position" of the invention, the reference value Vr corresponds to an example of a "reference value" of the invention, the range of the distance 1 from the detection region R corresponds to an example of a "predetermined range" of the invention, and the user interface 200 corresponds to an example of an "input operation portion" of the invention.

In addition, the invention is not limited to the above-described embodiments, and various changes to the description above are possible as long as the changes do not depart from the scope of the invention. Therefore, the aspects of the reference setting processing may be appropriately changed. For example, in the above-described first to the third control examples, by appropriately transporting the web S after the first mark M1 is once positioned in the detection region R, the first mark M1 is positioned at the detection start position Pd. However, as will be described next, with reference to the output value of the drum encoder E30 when the image I is printed in the printing processing performed in advance, it is also possible to directly move the first mark M1 to the detection start position Pd.

In the modification example, the output value of the drum encoder E30 at the time when the printing of the final image I is finished in the printing processing, is stored in the storage portion 110. In addition, when the transport of the web S is stopped as the printing processing is completed, the reverse transport of the web S is started. In addition, the printer control portion 100 stops the transport of the web S at a position at which the output value of the drum encoder E30 returns in the reverse direction Dr only by a distance which corresponds to the distance obtained by further adding the distance 1 to the transport distance La or the transport distance Lb from the output value at the time when the printing of the previous image I is finished (position adjustment operation). According to this, the first mark M1 is positioned at the detection start position Pd. Next, the printer control portion 100 stores the output value of the drum encoder E30 when the position adjustment operation is finished in the storage portion 110 as the reference value Vr (setting operation). Operations after this can be performed similar to the first to the third control examples. In the modification example, in the next printing processing, it is also possible to start the printing of the image from the appropriate position of the web S.

In addition, in the above-described first to the third control examples, by storing the output value of the drum encoder E30 when the first mark M1 is positioned at the detection start position Pd in the storage portion 110 as the reference value Vr, the reference setting processing is performed. However, a reset value obtained by resetting the output value of the drum encoder E30 can also be stored in the storage portion 110 as the reference value Vr, and the reference setting processing may be performed by resetting the output value of the drum encoder E30 when the first mark M1 is positioned at the detection start position Pd.

In addition, it is not necessary to perform the reference setting processing. In short, it is sufficient for the output value of the drum encoder E30 when the first mark M1 is at the detection start position Pd to be stored in the storage portion 110 as the reference value Vr. Therefore, it is also possible to perform the control illustrated in the next modification example. In other words, in the modification example, the output value of the drum encoder E30 when the final image I is printed in the previous printing processing is stored in the storage portion 110. In addition, the output value of the drum encoder E30 when the first mark M1, illustrating a position at which the printing is started in the printing processing planned to be performed next, is positioned at the detection start position Pd, is calculated based on the output value of the drum encoder E30 at the time when the printing of the previous image I is finished, and is stored in the storage portion 110 as the reference value Vr.

In addition, it is also possible to appropriately change the distance 1 between the detection region R and the detection start position Pd, and for example, the distance 1 may be set, for example, to be an appropriate value which is greater than zero and is less than the mark interval G, and for example, to be less than ½ of the mark interval G, or less than ⅓. Otherwise, the distance 1 may be equal to or greater than the mark interval G.

A specific configuration which confirms the transport position of the web S is not limited to the drum encoder E30, and may also be, for example, an encoder provided in the forward driving motor M31.

In addition, in the above-described example, the printer 1 which supports the web S by the rotation drum 30 is illustrated as an example. However, not being limited thereto, the support aspect of the web S can also support the web S having a shape of a flat plate.

This application claims priority under 35 U.S.C. §119 to Japanese Patent Application No. 2016-061282, filed Mar. 25, 2016. The entire disclosure of Japanese Patent Application No. 2016-061282 is hereby incorporated herein by reference.

What is claimed is:

1. A printing apparatus comprising:

a transport portion which transports a recording medium in a first direction;

a transport position output portion which outputs a transport position of the recording medium by the transport portion;

a printing portion which prints an image on the recording medium;

a mark detection portion which detects a mark in a detection region among a plurality of marks which are aligned in the first direction and are provided on the recording medium;

a storage portion which stores as a reference value an output value of the transport position output portion when a first mark that corresponds to a position at which printing of the image is started, is at a predetermined position with respect to the detection region among the plurality of marks; and a control portion which performs printing processing of printing the image on the recording medium by controlling the printing portion to start the printing of the image after controlling the transport portion to transport the recording medium in the first direction from a state where the first mark is positioned further on an upstream side in the first direction than the detection region, wherein the control portion controls a start timing of the printing of the image by the printing portion based on a timing at which the mark detection portion detects the mark, and the control portion controls the mark detection portion to detect the mark after confirming that the first mark reaches a predetermined range from the detection region based on comparison of an output value of the transport position output portion and the reference value with each other, in the printing processing.

2. The printing apparatus according to claim 1, wherein the storage portion stores the output value of the transport position output portion when the detection region is positioned between a second mark adjacent to the first mark and the first mark, at a predetermined interval from the first mark on the downstream side in the first direction, as the reference value.

3. The printing apparatus according to claim 2, wherein the control portion controls the start timing of the printing of the image by the printing portion based on a timing at which the mark detection portion first detects a mark after the output value of the transport position output portion matches the reference value.

4. The printing apparatus according to claim 1, wherein the control portion performs reference setting processing of matching the output value of the transport position output portion when the mark used as the first mark is at the predetermined position with respect to the detection region, and the reference value stored in the storage portion, before performing the printing processing planned to be performed next.

5. The printing apparatus according to claim 4, wherein the transport portion is adapted to transport the recording medium selectively in a second direction which is a reverse direction to the first direction and in the first direction, and wherein, in the reference setting processing, the control portion performs a position adjustment operation of positioning the first mark which corresponds to a printing start position of the image at the predetermined position in the printing processing planned to be performed next, by transporting the recording medium by the transport portion based on the output value of the transport position output portion when the printing of the image is finished in the printing processing performed in advance, and a setting operation of setting the reference value stored in the storage portion to the output value of the transport position output portion when the position adjustment operation is completed.

6. The printing apparatus according to claim 4, wherein the printing portion prints the image and the mark on the recording medium in the printing processing, wherein the transport portion is adapted to transport the recording medium selectively in a second direction which is a reverse direction to the first direction and in the first direction, and wherein, in the reference setting processing, the control portion performs a confirming operation of confirming the output value of the transport position output portion when the first mark is positioned at the detection region, a position adjustment operation of positioning the first mark at the predetermined position by adjusting the transport position of the recording medium to the transport portion based on the output value of the transport position output portion confirmed in the confirming operation, and a setting operation of setting the reference value stored in the storage portion to the output value of the transport position output portion when the position adjustment operation is completed.

7. The printing apparatus according to claim 6, wherein the control portion confirms the output value of the transport position output portion when the mark detection portion first detects a mark after starting the transport of the recording medium by the transport portion in the second direction from a state where the first mark is positioned further on an upstream side in the second direction than the detection region, in the confirming operation.

8. The printing apparatus according to claim 6, wherein the control portion confirms the output value of the transport position output portion when the mark detection portion first detects a mark after starting the transport of the recording medium by the transport portion in the first direction from a state where the first mark is positioned further on the upstream side in the first direction than the detection region, in the confirming operation.

9. The printing apparatus according to claim 4, further comprising:

an input operation portion, wherein the transport portion is adapted to transport the recording medium selectively in a second direction which is a reverse direction to the first direction and in the first direction in accordance with an input to the input operation portion, and wherein, in the reference setting processing, the control portion performs a position adjustment operation of positioning the first mark which corresponds to the printing start position of the image in the next printing processing at the predetermined position by transporting the recording medium by the transport portion based on an input to the input operation portion, and a setting operation of setting the reference value stored in the storage portion to the output value of the transport position output portion when the position adjustment operation is completed.

10. A printing method comprising:

starting transport of a recording medium in a first direction from a state where a first mark which corresponds to a position at which printing of an image is started is positioned further on an upstream side in the first direction than a detection region of a mark detection portion among a plurality of marks which are aligned in the first direction and are provided in the recording medium; and starting printing of an image on the recording medium transported in the first direction based on an output value of a transport position output portion which outputs a transport position of the recording medium, and a timing of detecting the mark in which the mark detection portion passes through the detection region, wherein the output value of the transport position output portion when the first mark is at a predetermined position with respect to the detection region is stored in a storage portion as a reference value, and wherein a start timing of the printing of the image is controlled based on the timing at which the mark detection portion detects the mark, and the mark detection portion detects the mark after a control portion confirms that the first mark reaches a predetermined range from the detection region based on comparison of the output value of the transport position output portion and the reference value with each other, when the transport in the first direction of the recording medium is started.

* * * * *